United States Patent [19]

Pratt

[11] Patent Number: 4,591,843

[45] Date of Patent: May 27, 1986

[54] DIGITAL DISPLAY SYSTEM

[75] Inventor: John M. Pratt, Macclesfield, England

[73] Assignee: International Computers Limited, London, England

[21] Appl. No.: 509,366

[22] Filed: Jun. 30, 1983

[30] Foreign Application Priority Data

Jul. 8, 1982 [GB] United Kingdom ..... 8219823

[51] Int. Cl.[4] ..... G09G 1/06

[52] U.S. Cl. ..... 340/728; 340/723; 340/732; 340/747; 340/793

[58] Field of Search ..... 340/723, 727, 728, 732, 340/744, 747, 793

[56] References Cited

U.S. PATENT DOCUMENTS

| | | | |
|---|---|---|---|
| 3,870,922 | 3/1975 | Shutoh | 340/747 |
| 3,984,664 | 10/1976 | Berwin | 340/732 |
| 4,237,457 | 12/1980 | Houldsworth | 340/728 |
| 4,262,290 | 4/1981 | Vallins | 340/728 |
| 4,314,351 | 2/1982 | Postel et al. | 340/732 |
| 4,371,872 | 2/1983 | Rossman | 340/723 |

*Primary Examiner*—Gerald L. Brigance
*Assistant Examiner*—Jeffery A. Brier
*Attorney, Agent, or Firm*—Lee, Smith & Zickert

[57] ABSTRACT

The system forms displays as an array of picture elements each of which can have more than two possible intensities (e.g. a grey scale). The circle generator derives the intensities for elements in and near an arc of a circle to be drawn. The intensity for an element is determined by the closest distance d from the element to an ideal circle characterizing the arc in such a way as to give a smoothed appearance. The distance d is obtained from a distance accumulator (39) and applied, adjusted for the width of the arc, to a sample table (42) holding the intensities. A step sequencer (40) causes the circle generator to execute scans along lines of picture elements across the arc. At each step d is changed by a distance increment or decrement obtained from one or both of two increment accumulators (36) and (37). These in turn are changed at each step by a constant amount obtained from a register (38) and equal to the step size divided by the radius of the ideal circle. Arcs are bounded by radial lines and may be abutted.

7 Claims, 4 Drawing Figures

DIGITAL DISPLAY SYSTEM

BACKGROUND OF THE INVENTION

This invention relates to digital display systems.

A digital display is normally formed as an array of picture elements whose intensities can be individually controlled. Examples are digitally controlled raster scanned CRTs and digital plotters. Early displays used only two values for the intensity of the picture elements—they were either illuminated or not illuminated—but more recent displays have allowed a greater range of intensities, either as a grey-scale monochrome display or as part of a color display.

It has been proposed to exploit the possibilities offered by a range of intensities to overcome one of the most disturbing features of displays with only two intensities, namely the jagged edges possessed by lines at an oblique angle. Picture elements in the neighborhood of an edge are given a graded intensity in a way that causes the edge to appear smooth even if it is at an oblique angle. In my U.S. patent application Ser. No. 488,368, I describe one such system in which the intensity of a picture element in the neighborhood of an edge is determined from its perpendicular distance from the edge. The system is capable of displaying both straight lines and circles; for circles the perpendicular distances for all points in the neighborhood of the circle are precalculated for each radius allowed and then stored in a look-up table. This method, while satisfactory for small radii, leads to inconveniently large look-up tables for large radii.

This invention provides a method of displaying an arc of a circle on a display device which produces an image as an array of picture elements arranged in lines, each picture element being capable of being displayed with a selected one from more than two possible intensities, the method comprising:

(A) for each of the said lines of picture elements that crosses the arc conducting a scan which comprises
  (a) for an initial picture element of the scan line deriving an indication of the closest distance from a sampling point corresponding to the element to an ideal circle characterising the line,
  (b) for each subsequent picture element of the scan deriving an indication of the closest distance from a sampling point corresponding to the element to the said ideal circle by incrementing or decrementing the corresponding indication of the preceding picture element, and
  (c) for each picture element of the scan deriving from at least the closest-distance indication for that element an indication of an intensity for the picture element; and (B) controlling the display device so that picture elements included in the said scans are displayed with the indicated intensity.

This invention also provides apparatus for controlling a display device to display an arc of a circle, the display device producing an image as an array of picture elements arranged in lines, each picture element being capable of being displayed with a selected one from more than two possible alternatives, the apparatus comprising:

(a) a first and a second picture-element address register, the first indicating a position for the picture element in the one of the said lines in which it lies and the second indicating a position for that line;

(b) sequencing means for conducting a sequence of scans, the sequencing means in each such scan repeatedly stepping the contents of the first address register from the value corresponding to one picture element to that corresponding to another and at the conclusion of each such scan stepping at least the contents of the second address register from the value corresponding to one line to that corresponding to another;

(c) means for holding an indication of the closest distance from the picture element whose position is indicated by the address registers to an ideal circle characterising the arc;

(d) means for incrementing or decrementing the contents of the means for holding the closest-distance indication to correspond to a step in each of the said scans;

(e) means responsive at least to the output of the means for holding the closest-distance indication to output an intensity indication for the element whose position is indicated by the address registers; and (f) means responsive to the intensity indications for issuing a drive signal to control a digital display device to display corresponding picture elements with the indicated intensity.

BRIEF DESCRIPTION OF THE DRAWINGS

A display system operating in accordance with the method of the invention and including apparatus in accordance with this invention will now be described in greater detail by way of example with reference to the accompanying drawings, in which.

DESCRIPTION OF THE PREFERRED EMBODIMENT

Outline of the system

Figure 1:
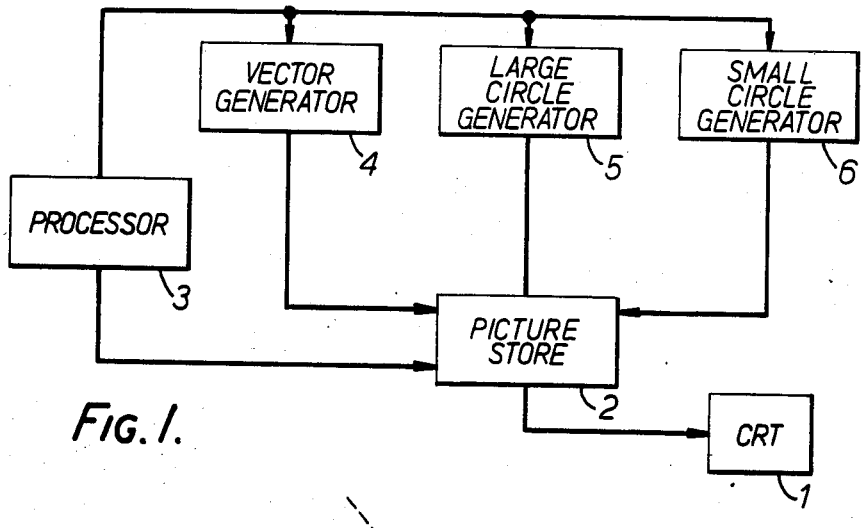
FIG. 1 is an overall block diagram.

Referring to FIG. 1, the system forms a display on a digitally controlled raster-scanned CRT 1. The display is made up of picture elements each of which is a spot created by intensifying the beam of the CRT 1. The picture elements lie in the scan lines of the beam and form a square array. Each picture element may have one of several possible intensities or grey levels.

The CRT 1 is refreshed from a picture store 2 which has a location for each picture element. Each location holds a value representing the intensity of that element. These values are read out in synchronism with the scan of the CRT and used to control the intensity of the beam.

A processor 3 determines the image that is to be displayed. It holds a high-level definition of the image and is capable of writing the intensities of individual picture elements into the picture store 2. However, for straight lines the calculation of intensities is carried out by a vector generator 4, for large circles it is carried out by a large-circle generator 5 and for small circles it is carried out by a small-circle generator 6. The processor 3 passes the parameters of the figure to the generator concerned which calculates the picture element intensities in the neighborhood of the object and writes them into the picture store 2. The vector generator 4 is as described in our earlier patent application referred to above. The large-circle generator 5 is an embodiment of this invention. The small-circle generator 6 is a circle generator as described in our earlier application, but used only for smaller circles.

Method of generating intensities

Figure 2:
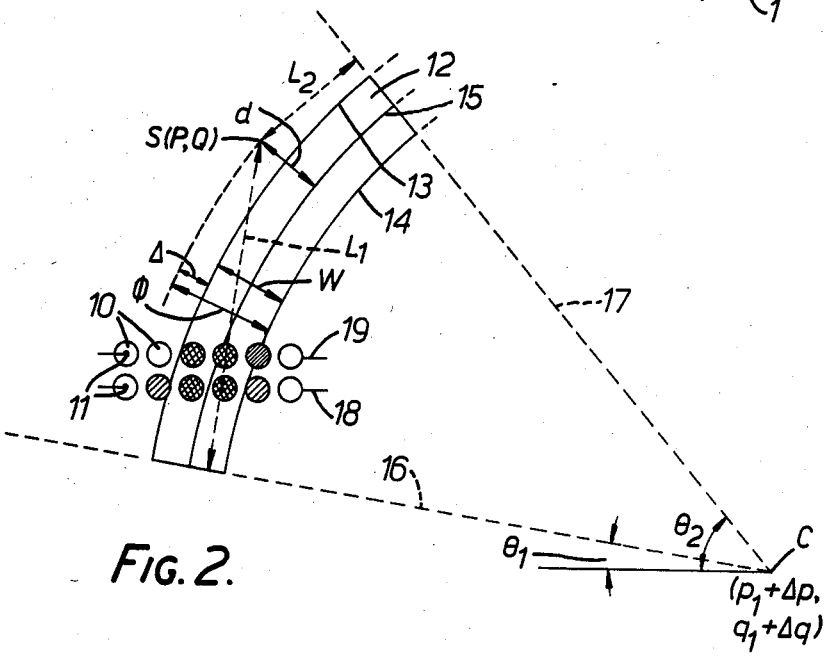
FIG. 2 is a diagram illustrating the display.

Referring to FIG. 2, the picture elements are spots 10, some only of which are shown. They are shown distinct but may in practice overlap. The points 11 at the centres of the picture elements are used as sample points in calculating intensities. The co-ordinates of a sample point will be denoted herein by (P,Q), using the distance between neighboring picture elements as the unit of distance. So increasing P by 1 corresponds to moving from one picture element to the next to the right and increasing Q by 1 corresponds to moving from one sample point to the next above it. P and Q together form the address of the location in the picture store 2 that holds the intensity of the element at (P,Q).

The circle generator 5 generates the intensities for an arcuate trace 12 bounded by an outer circle 13, an inner circle 14 and radial lines 16 and 17 at $\theta_1$ and $\theta_2$ to the horizontal. The processor 3 passes as parameters to the circle generator 5 quantities defining the co-ordinates of the centre C of the circles 13 and 14, the angles $\theta_1$ and $\theta_2$, the radius r of the circle 15 midway between the inner and outer circles 14 and 13 and the width w of the trace (either as a constant, or, as will be explained, as a variable). The co-ordinates of the centre C take the form $(p_1+\Delta p, q_1+\Delta q)$ where $p_1$ and $q_1$ are integers and $\Delta p$ and $\Delta q$ are fractional parts, since the circle generator 5 is capable of generating circles with centres positioned between sample points.

The general method of calculating intensities is to conduct scans along the lines in which the picture elements lie, such as the lines 18 and 19. These lines are chosen to be in the direction across the trace of the circle, that is to be horizontal at the sides of the circle and vertical at the top and bottom. For each picture element in the line in turn (in the neighbourhood of the arc 12) the circle generator calculates the distance d from the mid-circle 15. From the distance d and the width w the circle generator derives the distances $\Delta$ and $\phi$ to the nearer and farther edges 13 and 14 of the arc (with S outside the circle as shown). From these quantities the intensity is calculated. The calculation ignores the fact that the arc is curved and treats it as a straight line with the centre line a distance d from S and having the same width w. This approximation is satisfactory of circles of radius greater than 16; smaller circles are generated by the small-circle generator 6, which holds values for radii up to 16.

The calculation of intensities may be as described in detail in the earlier application; briefly, it is a one-dimensional integration along the normal through the sampling point using a triangular sampling function of width 2.

Calculation of distance

The distance d from the point S to the circle 15 is given by $$d = \sqrt{(p^2 + q^2)} - r$$

where p and q are the co-ordinates of S relative to the centre C.

The rate of change of d with respect to p is $$\frac{p}{\sqrt{(p^2 + q^2)}}$$

Since S is close to the circle 15

$$\sqrt{(p^2 + q^2)}$$

can be approximated by r, so $$\frac{\delta d}{\delta p} \simeq \frac{p}{r}$$

Hence a change of 1 in p leads to a change p/r in d. This horizontal distance increment itself changes by a constant second-order difference 1/r when p is changed by 1. The circle generator 5 holds the quantity 1/r as a constant. When the scan steps from one picture element to its neighbour in the scan line, changing p by 1, it changes the previous value of the horizontal distance increment by 1/r. Then it changes the previous value of the distance d by the new value of the horizontal distance increment.

A change of q by 1 (a vertical step) similarly leads to a change in d of q/r, and a change in this quantity by 1/r. The vertical distance increment is held separately and updated for a vertical step and then used to change d.

It will be understood that the changes referred to above are either additions or subtractions depending on the position of the sample point relative to the circle to be drawn.

Scanning sequence

Figure 3:
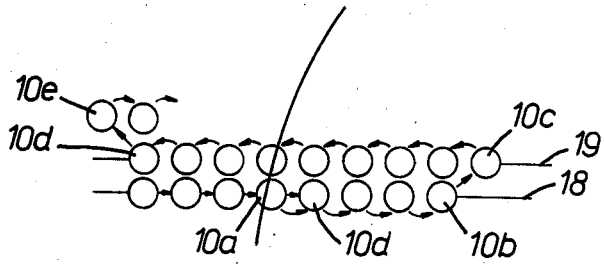
FIG. 3 shows the scanning method.

Referring to FIG. 3, assume the scan of a line, the line 18 say, has reached a picture element 10*a*. The distance and then intensity are calculated for that element. The scan then steps horizontally by changing p repeatedly by 1 (since that is the direction across the trace of the circle) and at each step the calculations are repeated. When it is detected at an element 10*b* that the intensity equals a limiting value (usually that of the background) the scan of the line 18 ends.

A diagonal step is now made by incrementing both p and q, taking the scanning sequence to an element 10*c*. The scan now travels back along the line 19. Since the scan direction (p or q) has previously been chosen to be across the circle, the sample at the start of line 19 will be outside the image of the circle. The scan now traverses line 19 until the outside limit of the circle is reached at an element 10*d*. Again a 45° step is made, in the direction away from the circle, to an element 10*e*.

This sequence continues until the slope of the circle changes through 45°. At this point the scan direction is changed from p to q, or vice versa, in order to keep the direction of scanning across the circle. This point is detected effectively by testing for $p>q$ (in absolute magnitudes), and the change is made at the outside turning point of the scan in order to avoid an unscanned area.

Large circle generator

Figure 4:
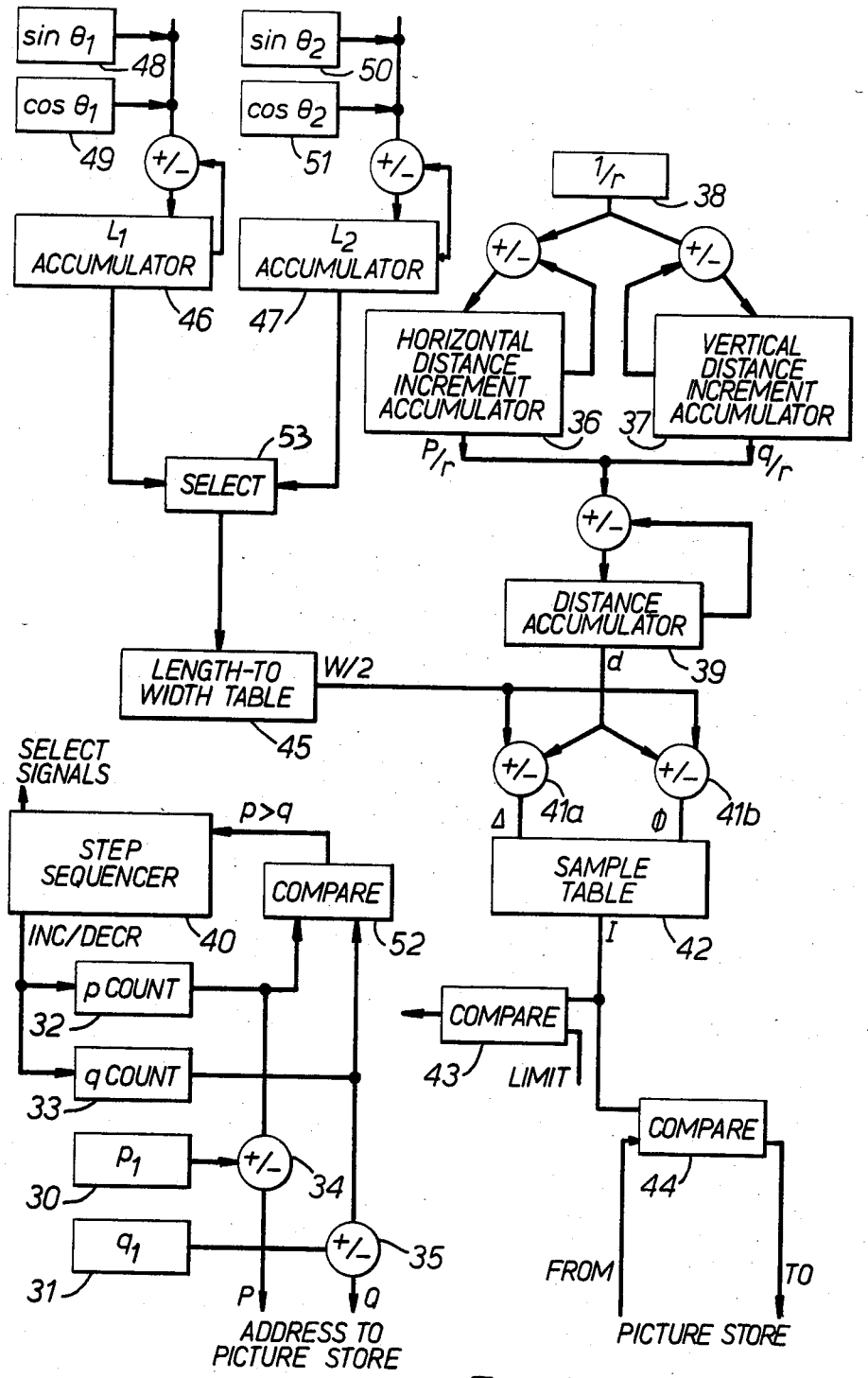
FIG. 4 is a block diagram of the large circle generator.

Referring to FIG. 4, the large circle generator 5 is constructed to operate as described. It holds the integral parts $p_1$ and $q_1$ of the center C of the circle in registers 30 and 31 respectively. A p' counter 32 and a q' counter 33 hold the co-ordinates of the sampling point S relative to the point $(p_1,q_1)$ (rather than the center of the circle). $p_1$ and p' are added by an adder 34 and $q_1$ and q' are added by an adder 35 to give the absolute co-ordinates P and Q of the sampling point. P and Q are supplied to the picture store as the addressing signals.

The horizontal and vertical distance increments are held in accumulators 36 and 37 respectively.

Where there is a fractional offset to the center of the circle $p' = p - \Delta p$ and the horizontal distance increment accumulator 36 is loaded for the initial point of the scanning sequence with the quantity $(p' - \Delta p))/r$. The vertical distance increment accumulator similarly receives $(q' - \Delta q)/r$.

The second order difference 1/r is held into a register 38 whose output may be added to or subtracted from the increment accumulators 36 and 37. Their outputs may be added to or subtracted from an accumulator 39 which holds the distance d.

A microprogrammed step sequencer 40 controls the steps of the scan by incrementing or decrementing the p' and q' counters 32 and 33 and also controls the order and manner in which the additions and subtractions just referred to take place so as to cause the method described to be carried out. The distance d output from the distance accumulator 39 passes to adder/subtracters 41*a* and 41*b*, where it is combined with w/2 to give the quantities $\Delta$ and $\phi$ referred to previously. These quantities are used to address a precalculated sample table 42 whose output is the intensity I of the picture element concerned. I is compared with the limiting value in a comparator 43 which issues a signal to the step sequencer 40 to change the direction of scan when the limit is reached. I is also compared in a comparator 44 with the existing value of the intensity for that value. That allows merging of the new values with those already present, for example to ensure that new intensities are only written into the store if they are greater than the existing ones.

The distances $L_1$ and $L_2$ from the sample point S to the bounding lines 16 and 17 (see FIG. 2) are held in accumulators 46 and 47. These accumulators are changed at each step by adding or subtracting the appropriate increment, which for a fixed direction of scan is a constant. Thus for a change of 1 in the p direction the $L_1$ accumulator 46 is changed by sin $\theta_1$, obtained from a register 48. For a change of 1 in the q direction it is changed by cos $\theta_1$, obtained from a register 49. Similarly, the $L_2$ accumulator 47 is changed by sin $\theta_2$ or cos $\theta_2$ obtained from registers 50 and 51 respectively.

The values of $L_1$ and $L_2$ are used to control the intensities of the picture elements at the ends of the arc. These ends can be selected to have either of two styles. The first intensifies only those picture elements whose centers lie inside the bounding lines 16 and 17. If this style is chosen, a value of less than zero in either accumulator inhibits the intensity from being written into the picture store. This first style is liable to give a jagged appearance to the end, but is convenient if abutting arcs of the same circle are to be drawn, as will be explained.

The second style gives a more precisely positioned appearance to the ends of arcs, and is also explained in more detail in the earlier application previously referred to. With this style the width of the arc is treated as tapering in the neighborhood of the ends. The lesser of the values of $L_1$ and $L_2$ (i.e. the nearer edge) is selected by a circuit 53 and applied to a length-to-width table 45 which outputs the width of the trace at that distance from the end (in fact as w/2).

This value is then combined with d to give the values $\Delta$ and $\theta$ applied to the sample table 42. For points away from the ends of the arc the length-to-width table 45 outputs a constant value.

A comparator 52 indicates to the step sequencer 40 when p is greater than q to allow the step sequencer to change the direction of scan to keep it more across the arc. As explained, the change is made outside the circle.

In operation, when an arc is to be drawn the processor loads the register 38 with 1/r, the registers 30 and 31 with $(p_1, q_1)$, and the registers 48–51 with the values of the appropriate functions of $\theta_1$ and $\theta_2$. It indicates the style of ends required and writes the width into the table 45, together with the values of the tapering ends if required. The processor also chooses a starting point for the scan and loads the p' and q' counters 32 and 33 and the distance and length accumulators 39, 46 and 47 with the corresponding values. It loads the increment accumulators 36 and 37 with the values of p/r and q/r, adjusted as explained for any fractional offset of the center of the circle. It then initiates the scan in the direction across the arc.

The initial point is chosen to be just beyond the first line to contain a picture element to be intensified. The scanning sequence is ended after the first all-zero scan line after non-zero intensities have been met.

Arcs or more than 90°, and complete circles, are divided into sections of no more than 90°, each of which is generated separately. Where the sections abut, the first style of edge is used.

Various modifications are possible. The arc to be drawn may be divided into sections by lines at 45° or 135° to the lines of picture elements. The scan direction is then constant in p or q and can be indicated by the processor.

The arc may be a line of variable thickness. In this case one of the boundary lines 16 or 17 is chosen as the datum from which length along the arc is measured and the output of the corresponding length accumulator 46 and 47 is used to address the length-to-width table 45, into which the variable width is written. To limit inaccuracies it is then convenient to divide arcs into 45° sections.

The arc to be drawn need not only be a line, it may be an edge for example. The whole segment of the circle bounded by the chosen arc and bounding radii may be filled. In this case d is the distance to the circular edge and applied direct to the sample table 42, which contains appropriate values. The other edges are then controlled by $L_1$ and $L_2$, and may be exact (to allow abutting) or smoothed, that is defined by picture elements whose intensities vary in accordance with distance from the edge.

When used with a colour display, provided the brightness is calculated as described for picture elements near the edge the colour, which is less important for smoothing the edges, may be interpolated by any suitable method.

If desired, instead of the distance increments being obtained by accumulating second order differences, they may be calculated directly by dividing the value of p or q by r.

Various styles of image—for example light-on-dark or with outlined edges—may be produced, as also described in the application referred to above.

I claim:

1. A method of displaying an arc of a circle on a display device element being capable of being displayed with a selected one from more which produces an image as an array of picture elements, each picture than two possible intensities, the method comprising:

A. scanning the picture elements along a plurality of scan lines crossing the arc, and for each scan line performing the steps:

(a) for an initial picture element of the scan line deriving an indication of a closest distance from a sampling point corresponding to the element to an ideal circle characterising the arc, (b) for each subsequent picture element of the scan line, deriving an indication of a closest distance from a sampling point corresponding to the element to the said ideal circle by incrementing or decrementing the closest distance indication derived for the preceding picture element by adding or subtracting a change indication, (c) for each said subsequent picture element, incrementing or decrementing said change indication by addition or subtraction of an amount proportional to the inverse of the radius of the ideal circle, and (d) for each picture element of the scan line, deriving from at least the closest distance indication for that element an indication of an intensity for the picture element; and B. controlling the display device so that picture elements included in the said scan lines are displayed with the indicated intensity.

2. Apparatus for controlling a display device to display an arc of a circle, the display device producing an image as an array of picture elements arranged in a plurality of scan lines, each picture element being capable of being displayed with a selected one from more than two possible intensities, the apparatus comprising:

(a) a first and a second picture element address register, the first containing a position value for a picture element in the one of the said scan lines in which it lies and the second containing a position value for that scan line:

(b) sequencing means for conducting a sequence of scans, the sequencing means in each such scan repeatedly stepping the contents of the first address register from the value corresponding to one picture element to that corresponding to another and at the conclusion of each such scan stepping at least the contents of the second address register from the value corresponding to one scan line to that corresponding to another, (c) means for holding an indication of a closest distance from the picture element whose position is indicated by the address registers to an ideal circle characterising the arc;

(d) means for incrementing or decrementing the content of the means for holding the closest distance indication;

(e) means responsive at least to an output of the means for holding the closest distance indication to output an intensity indication for the element whose position value is contained in the address registers;

(f) means for outputting a signal indicating that the intensity indicated for an element has reached a predetermined value, in response to which signal the sequencing means terminates the scan of the current line; and (g) means responsive to the intensity indications for issuing a drive signal to control a digital display device to display corresponding picture elements with the indicated intensity.

3. A method as claimed in claim 1, in which each scan is terminated in response to an indication that the indicated intensity derived for a picture element has reached a predetermined value.

4. Apparatus as claimed in claim 2, in which the incrementing or decrementing means comprises means holding an indication of the increment or decrement and means for incrementing or decrementing the contents of the last-mentioned means by an amount corresponding to a constant change in the increment or decrement proportional to the inverse of the radius of the said ideal circle.

5. Apparatus as claimed in claim 2, in which the contents of the first and second address registers indicate the position of a picture element with respect to the center of the said circle or a neighboring point.

6. A display system comprising apparatus as claimed in claim 2 in combination with a display device responsive to the said drive signal.

7. A method as claimed in claim 1 wherein the scan paths are selected to lie in a direction not more than 45% from a direction normal to the arc.

* * * * *